US007967106B2

(12) United States Patent
Ross et al.

(10) Patent No.: US 7,967,106 B2
(45) Date of Patent: Jun. 28, 2011

(54) AIR INDUCTION SOUND MODIFICATION SYSTEM FOR INTERNAL COMBUSTION ENGINE

(75) Inventors: Tony Ross, Belleville, MI (US); Steve Droste, Ypsilanti, MI (US); Harwinder Hehar, Canton, MI (US); Jose Arteaga, Dearborn, MI (US)

(73) Assignee: Ford Global Technologies, Dearborn, MI (US)

( * ) Notice: Subject to any disclaimer, the term of this patent is extended or adjusted under 35 U.S.C. 154(b) by 304 days.

(21) Appl. No.: 12/053,677

(22) Filed: Mar. 24, 2008

(65) Prior Publication Data

US 2009/0236172 A1 Sep. 24, 2009

(51) Int. Cl.
*F02M 35/00* (2006.01)

(52) U.S. Cl. ..... 181/229; 181/214; 181/240; 181/224; 123/184.54; 123/184.53; 123/184.55; 123/184.56; 123/184.57

(58) Field of Classification Search ..... 181/229, 181/214, 224, 240; 123/184.53, 184.57, 123/184.55, 184.54, 184.56, 184.61
See application file for complete search history.

(56) References Cited

U.S. PATENT DOCUMENTS

| | | | | |
|---|---|---|---|---|
| 4,846,300 | A | 7/1989 | Boda | |
| 5,134,852 | A * | 8/1992 | Weeks | 60/323 |
| 5,575,249 | A | 11/1996 | Mielke et al. | |
| 5,756,945 | A * | 5/1998 | Maeda et al. | 181/272 |
| 6,009,705 | A * | 1/2000 | Arnott et al. | 60/312 |
| 6,199,657 | B1 | 3/2001 | Misawa et al. | |
| 6,415,889 | B1 * | 7/2002 | Wyatt | 181/282 |
| 6,435,303 | B1 * | 8/2002 | Warnaka | 181/286 |
| 6,792,907 | B1 | 9/2004 | Kostun et al. | |
| 6,932,189 | B2 * | 8/2005 | Helber et al. | 181/240 |
| 7,000,583 | B2 * | 2/2006 | Kino et al. | 123/184.53 |
| 7,198,017 | B2 * | 4/2007 | Vogt et al. | 123/184.57 |
| 7,353,791 | B2 * | 4/2008 | Sasaki et al. | 123/184.57 |
| 7,448,353 | B2 * | 11/2008 | Shinada et al. | 123/184.57 |
| 2008/0257346 | A1 * | 10/2008 | Lathrop et al. | 128/204.17 |
| 2009/0242323 | A1 * | 10/2009 | Densmore et al. | 181/229 |

FOREIGN PATENT DOCUMENTS

JP 10-274117 10/1998

* cited by examiner

*Primary Examiner* — Forrest M Phillips
(74) *Attorney, Agent, or Firm* — Jerome R. Drouillard; Julia Voutyras

(57) ABSTRACT

An air induction sound modification system for an internal combustion engine includes a multi-frequency sound suppression unit having Helmholtz resonators and a multi-component expansion chamber. A sound generator, which functions to radiate sound at a desirable, tuned frequency, extends between the multi-function sound suppression unit and a second expansion chamber, such as an air cleaner box.

8 Claims, 2 Drawing Sheets

AIR INDUCTION SOUND MODIFICATION SYSTEM FOR INTERNAL COMBUSTION ENGINE

CROSS REFERENCE TO RELATED APPLICATIONS

None.

BACKGROUND OF THE INVENTION

1. Field of the Invention

The present invention relates to a system for changing the sound output of an internal combustion engine air induction system by suppressing unwanted noise at selected frequencies and by increasing the emission of sound at desired, preselected frequencies.

2. Related Art

In the world of automotive internal combustion engines, psychoacoustics is important because the motorist's perception of a vehicle's roadworthiness is greatly influenced by the sound of the engine within a vehicle. In other words, motorists listen to their engine as an indication of not only the engine's health, but also the power output of the engine. Needless to say, it is disadvantageous to install a powerful engine in a car or truck, only to have poor sound quality which fails to adequately convey to the driver and passengers the engine's capabilities. And, in any event, it is desirable to suppress sound at certain frequencies to obtain a pleasing sound characteristic, or signature, for an engine. Automotive designers have used Helmholtz resonators in the past to obtain desired induction system tuning. However, such resonators were frequently branched from air induction pipes at odd locations, creating a very odd appearance, with structures which were difficult to package within the confines of the underhood environment of a vehicle.

It would be desirable to provide a noise treatment system for an air induction system of an internal combustion engine, particularly an automotive internal combustion engine, in which the various components of the system are packaged within a single housing which efficiently not only tunes induction sound by suppressing undesired frequencies, but also provides at least a portion of a system promoting desirable frequencies, while minimizing flow losses through the sound treatment device.

BRIEF DESCRIPTION OF THE INVENTION

According to an aspect of the present invention, an air induction sound modification system for an internal combustion engine includes a multi-frequency sound suppression unit having a housing. An air induction passage extends through the housing, which is preferably constructed with two halves, akin to a clamshell. A number of Helmholtz resonators branch from the air induction passage in the housing. A first expansion chamber is also located within the clamshell housing, downstream from the Helmholtz resonators, with the expansion chamber having a number of quarter wave resonators. A sound generator, including a section of the central air induction passage, extends upstream from the expansion chamber, past the Helmholtz resonators to a second expansion chamber.

According to another aspect of the present invention, an air induction passage extends through the first expansion chamber at a position which, although generally centrally located with reference to the chamber, is, in the preferred embodiment, asymmetric with respect to the expansion chamber.

This permits the expansion chamber to be configured with at least two quarter wave resonators which may be used to suppress separate frequencies of undesirable sound.

According to another aspect of the present invention, the central air induction passage enters the sound suppression unit housing at an acute angle and exits from the expansion chamber with an offset which minimizes impingement of the exiting induction air upon a wall of the central induction passage, whereby flow losses will be minimized.

According to another aspect of the present invention, the housing defines not only the first expansion chamber, but also the aforementioned Helmholtz resonators, with the housing having an upper portion and a lower portion, and with each of the Helmholtz resonators having a semi-cylindrical neck segment formed in each of the upper portion and the lower portion of the housing.

It is an advantage of a sound modification system according to the present invention that undesirable induction sounds, having several different frequencies, may be suppressed.

It is another advantage of an induction sound modification system according to the present invention that the majority of components of the system are housed within a single, compact housing.

It is yet another advantage of an induction sound modification system according to the present invention that desirable sound may be not only promoted, but also created by the present system.

Other advantages, as well as features of the present invention, will become apparent to the reader of this specification.

DETAILED DESCRIPTION OF THE PREFERRED EMBODIMENTS

Figure 3:
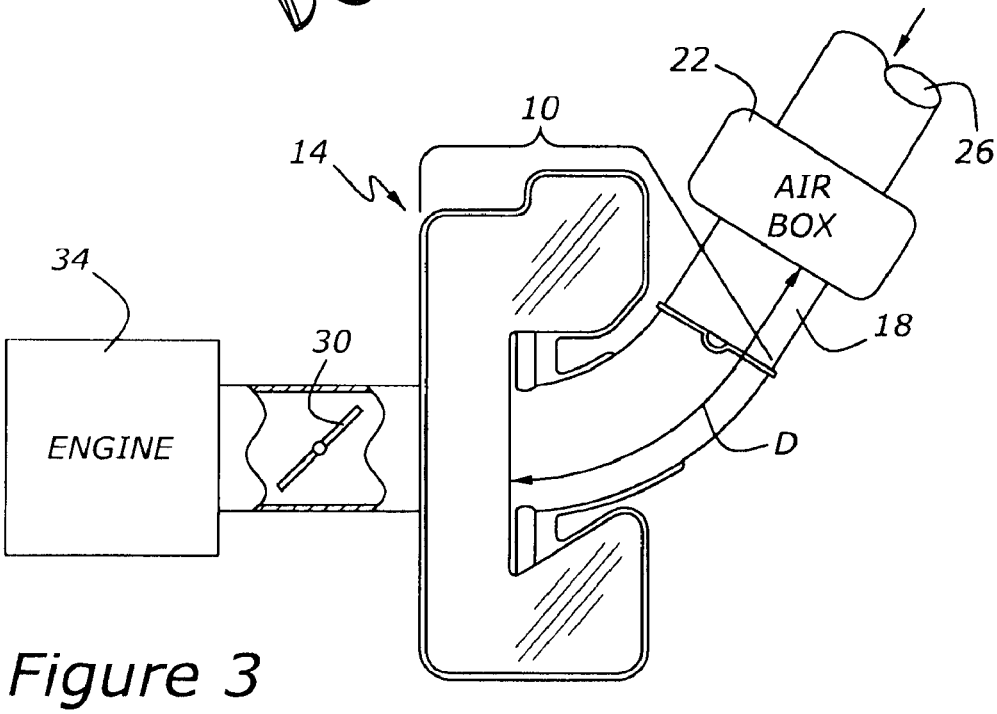
FIG. 3 illustrates a schematic of an engine air induction sound modification system according to the present invention.

As shown in FIG. 3, an engine, 34, draws air through an air induction sound modification system, 10, which is mounted between a throttle body containing throttle plate, 30, and an expansion chamber which is the second of two expansion chambers in the system, and which functions as an air cleaner box. Air enters the engine's induction system through air inlet opening 26. Air induction sound modification system 10 includes at least two components: a multi-frequency sound suppression unit, 14, and a sound generator, 18, extending from second expansion chamber 22 to throttle plate 30. Multi-frequency sound suppression unit 14 functions to eliminate unwanted frequencies from the sound emitted by the air induction system. Sound generator 18, on the other hand, functions to emit sound at desirable frequencies. Accordingly, the present system is properly termed a "sound modification system" because it not only eliminates undesirable sound, but also amplifies and projects wanted sounds.

Figure 1:
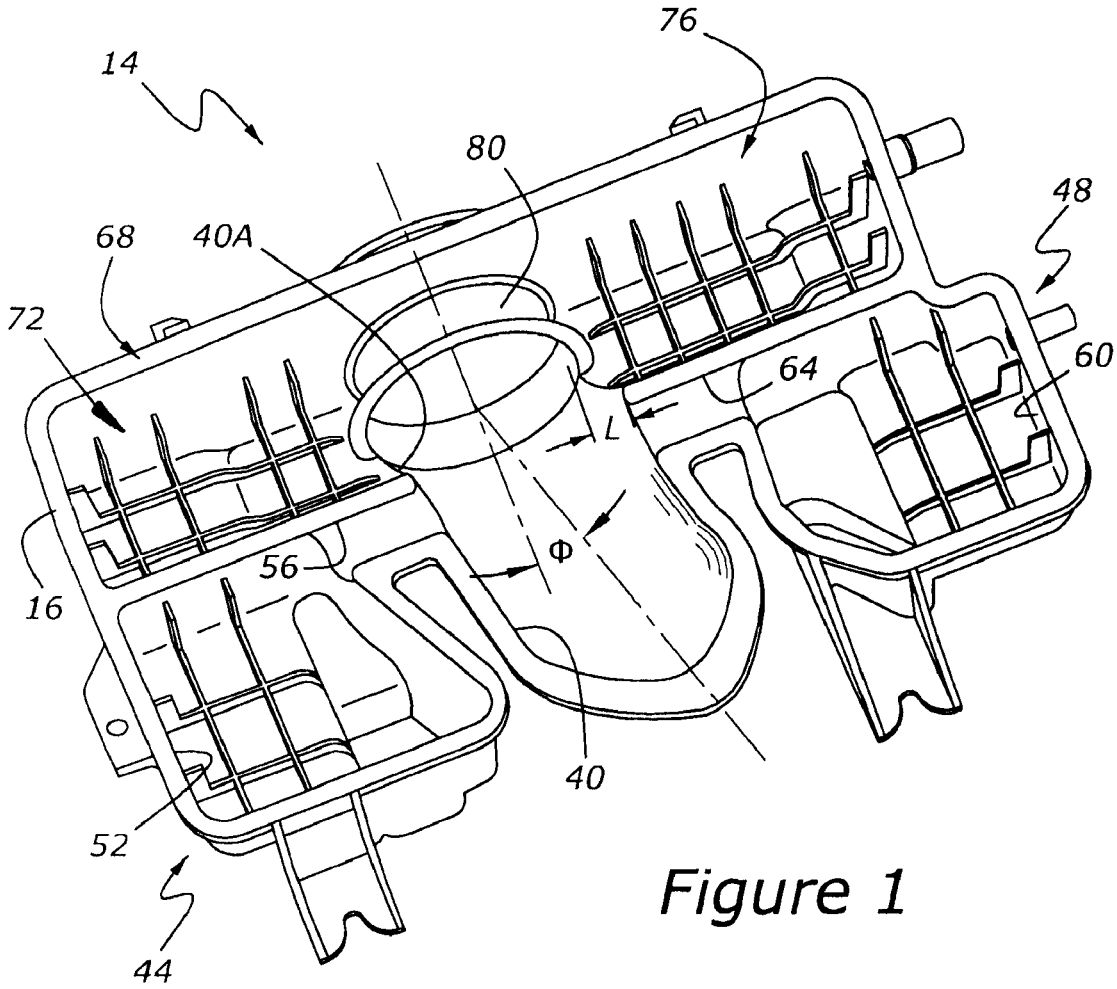
FIG. 1 is a perspective view of a lower portion of a multi-frequency sound suppression unit housing according to an aspect of the present invention.

FIG. 1 illustrates a lower portion, 16, of a clamshell housing 15 (FIG. 2), which encompasses multi-frequency sound suppression unit 14. An air induction passage, 40, which enters sound suppression unit 14 at an acute angle, Φ, and which exits from first expansion chamber 68 with an offset, L, noted in FIG. 1, serves to allow air to pass through multi-frequency sound suppression unit 14. Because of offset L, passage of induction air through multi-frequency sound suppression unit 14 is accompanied by only a minimal loss in terms of flow energy. This is because the offset illustrated at L allows air to pass out of expansion chamber 68 without impinging upon wall 40A of the air induction passage 40 to any significant degree. Air exits from unit 14 through an elastomeric cuff, 80, which is snapped into place in an exterior wall of expansion chamber 68.

FIG. 1 illustrates four different resonators which are embodied in multi-frequency sound suppression unit 14. Two Helmholtz resonators, 44 and 48, are included, with Helmholtz resonator 44 having a tuning chamber, 52, and a neck, in this case a semi-cylindrical neck, 56, connecting chamber 52 to air induction passage 40. The second Helmholtz resonator, 48, has a tuning chamber, 60, which is connected with air induction passage 40 by semi-cylindrical neck, 48. Necks 56 and 54 are said to be semi-cylindrical because the portions of the necks formed in lower portion 16 of clamshell housing 15 only include half of the neck itself, with the other half being provided by the upper portion 17 of clamshell housing 15. The upper portion of clamshell housing 15 is shown in FIG. 2.

FIG. 1 also shows two quarter wave resonators, 72 and 76, which, taken together, define a first expansion chamber, 68. Quarter wave resonators 72 and 76 are more narrowly focused than are Helmholtz resonators 44 and 48, but are nevertheless employed advantageously to suppress undesirable frequencies in the sound being emanated by the air induction system. Those skilled in the art will appreciate, in view of this disclosure, that quarter wave resonators 72 and 76 could be further subdivided and changed in volume and length so as to change the frequencies or, indeed, add additional frequencies for attenuation purposes. Note that, because of the asymmetry as shown by length L, first expansion chamber 68 will suppress undesirable noise at two separate frequencies, at a minimum.

Sound generator 18, as noted above, extends between multi-frequency sound suppression unit 14 and air cleaner box 22 (FIG. 3). Expansion chamber 68 breaks up a standing wave which could otherwise be set up between air cleaner box 22 and throttle plate 30. The length of sound generator 18 is set at a length such that the total length of the airflow path between air box 22 and the entry to expansion chamber 68 (the path length labeled "D" in FIG. 3), approximates the half wave length of a desirable sound power frequency, for example, 270 Hz, so that sound generator 18 will radiate a pleasing sound associated with a powerful vehicle, at a desired, tuned frequency.

Figure 2:
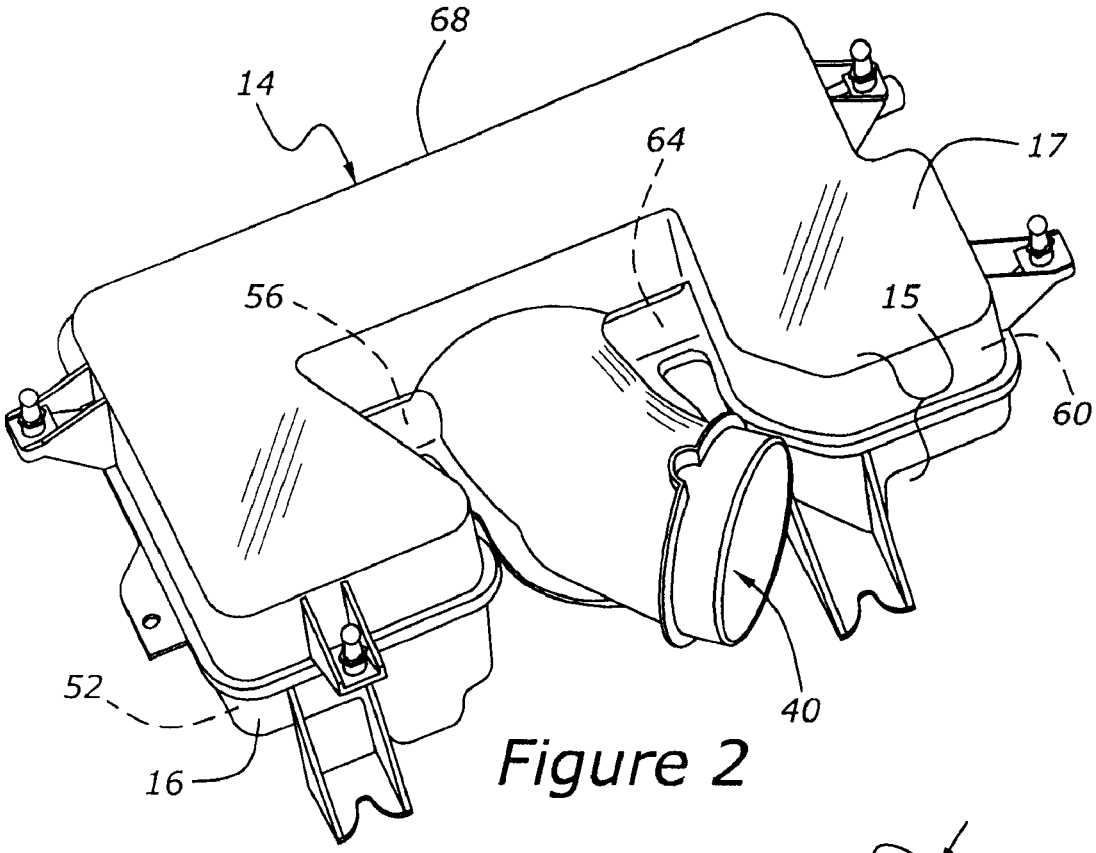
FIG. 2 is a perspective view of a complete multi-frequency sound suppression unit according to an aspect of the present invention.

FIG. 2 shows a completed air induction multi-frequency sound suppression unit 14, including an upper portion of housing 15. FIG. 2 also shows, with more clarity, the acute angle at which central air induction passage 40 enters sound suppression system 14. Lower portion 16 and upper portion 17 of clamshell housing 15 are configured in molded plastic, which may be welded by friction welding, solvent welding, or other welding or bonding processes, to form the various component parts of sound suppression unit 14 such as Helmholtz resonator chambers 52 and 60 and tuning necks 56 and 64, respectively. The parting line between lower portion 16 and upper portion 17 of housing 15 may advantageously be set, as illustrated, at a location which bisects tuning necks 56 and 64.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. An air induction sound modification system for an internal combustion engine, comprising:

a multi-frequency sound suppression unit, comprising:

a central air induction passage:

a plurality of Helmholtz resonators branching from the air induction passage, with each of said Helmholtz resonators being tuned to suppress sound at a different predetermined frequency; and a first expansion chamber located downstream from the Helmholtz resonators, with said expansion chamber having a plurality of quarter wave resonators configured to suppress sound at a plurality of predetermined frequencies, with said central air induction passage comprising a sound generator extending upstream from said expansion chamber and past said Helmholtz resonators to a second expansion chamber, with said sound generator having a length selected to approximate the half wave length of a desirable sound power frequency, whereby the sound generator will produce sound at said desired frequency.

2. An air induction sound modification system according to claim 1, wherein said multi-frequency sound suppression unit comprises a housing defining not only said first expansion chamber, but also said Helmholtz resonators, with said housing having an upper portion and a lower portion, and with each of said Helmholtz resonators having a semi-cylindrical neck segment formed in each of said upper portion and said lower portion.

3. An air induction sound modification system according to claim 2, wherein said upper portion and said lower portion of said housing are formed from molded plastic.

4. An air induction sound modification system according to claim 3, wherein said housing is assembled by friction welding said upper portion of said housing to said lower portion.

5. An air induction sound modification system according to claim 1 further comprising a molded elastomeric transition connector mounted to the exit of said first expansion chamber.

6. An air induction sound modification system for an internal combustion engine, comprising:

a multi-frequency sound suppression unit, comprising:

a housing;

a central air induction passage extending through said housing;

a plurality of Helmholtz resonators formed in said housing and branching from the air induction passage, with each of said Helmholtz resonators being tuned to suppress sound at a different predetermined frequency, and with each of said Helmholtz resonators having a tuning chamber connected with said central air induction passage with a neck; and a first expansion chamber formed in said housing and located downstream from and adjacent to the Helmholtz resonators, with said expansion chamber having a plurality of quarter wave resonators configured to suppress sound at a plurality of predetermined frequencies with said central air induction passage comprising a sound generator extending upstream from said expansion chamber and past said Helmholtz resonators to a second expansion chamber, with said sound generator having a length selected to approximate the half wave length of a desirable sound power frequency, whereby the sound generator will produce sound at said desired frequency.

7. An air induction sound modification system according to claim 6, wherein said housing comprises a welded plastic clamshell assembly.

8. An air induction sound modification system according to claim 6, wherein said housing comprises a welded plastic clamshell assembly having a parting line bisecting a plurality of tuning necks of said Helmholtz resonators.

* * * * *